US010689074B2

(12) United States Patent
Bonte et al.

(10) Patent No.: US 10,689,074 B2
(45) Date of Patent: Jun. 23, 2020

(54) RETRACTABLE THRUSTER SYSTEM

(71) Applicant: GustoMSC Resources B.V., Schiedam (NL)

(72) Inventors: Sibren Jort Bonte, Schiedam (NL); Michiel Giovanni Mol, Schiedam (NL); Michiel Krekel, Schiedam (NL)

(73) Assignee: GustoMSC B.V., Schiedam (NL)

( * ) Notice: Subject to any disclaimer, the term of this patent is extended or adjusted under 35 U.S.C. 154(b) by 99 days.

(21) Appl. No.: 15/768,093

(22) PCT Filed: Oct. 17, 2016

(86) PCT No.: PCT/NL2016/050712

§ 371 (c)(1),
(2) Date: Apr. 13, 2018

(87) PCT Pub. No.: WO2017/065614

PCT Pub. Date: Apr. 20, 2017

(65) Prior Publication Data

US 2018/0297679 A1 Oct. 18, 2018

(30) Foreign Application Priority Data

Oct. 15, 2015 (NL) ..... 2015624
Jul. 28, 2016 (NL) ..... 2017249

(51) Int. Cl.
*B63H 5/125* (2006.01)
*B63H 25/42* (2006.01)

(52) U.S. Cl.
CPC ..... *B63H 5/125* (2013.01); *B63H 25/42* (2013.01); *B63H 2005/1254* (2013.01); *B63H 2025/425* (2013.01)

(58) Field of Classification Search
CPC ..... B63H 5/125; B63H 2005/1254
See application file for complete search history.

(56) References Cited

U.S. PATENT DOCUMENTS 6,439,936 B1 * 8/2002 Dreith ..... B63B 17/0018 114/144 B
8,715,021 B2 * 5/2014 Horkko ..... B63B 17/0018 440/54

(Continued)

FOREIGN PATENT DOCUMENTS

CN 102414079 A 4/2012
EP 2979972 A1 2/2016

(Continued)

OTHER PUBLICATIONS

Jan. 20, 2017 ISR and Written Opinion PCT/NL2016/050712.
May 8, 2017—National Search Report NL2017249.

*Primary Examiner* — S. Joseph Morano
*Assistant Examiner* — Jovon E Hayes
(74) *Attorney, Agent, or Firm* — Banner & Witcoff, Ltd.

(57) ABSTRACT

Retractable thruster system for moving a thruster (1) on a vessel between an extended position, in which the thruster (1) is extended below a hull's bottom, and at least one retracted position, in which the thruster is located above the hull's bottom, the system comprising a canister (2) to which a thruster is mountable, wherein the canister is configured to be movable in a trunk (3) in a vessel's hull structure between said extended position and said at least one retracted position, and in which a rack-and-pinion lifting system is arranged to move the canister (3) in said trunk (3) between said extended position and said at least one retracted position, the lifting system including at least one rack (6) being fixedly connected to the vessel, and a pinion drive (7) including at least one pinion (8) arranged to cooperate with said at least one rack (6), said pinion drive being connected to the canister (2).

16 Claims, 15 Drawing Sheets

(56) References Cited

U.S. PATENT DOCUMENTS

| | | | | |
|---|---|---|---|---|
| 8,926,382 | B2 * | 1/2015 | Van Der Kam | B63H 21/17 440/54 |
| 2014/0341734 | A1 * | 11/2014 | Ahn | B63H 5/125 416/54 |
| 2016/0119826 | A1 | 4/2016 | Huh et al. | |
| 2018/0297679 | A1 * | 10/2018 | Bonte | B63H 25/42 |

FOREIGN PATENT DOCUMENTS

| | | | | | |
|---|---|---|---|---|---|
| KR | 20140133336 | A | | 11/2014 | |
| KR | 20140133336 | A | * | 11/2014 | B63H 25/42 |
| KR | 20140133348 | A | | 11/2014 | |
| KR | 20140135861 | A | * | 11/2014 | B63H 25/42 |
| KR | 20140135861 | A | | 11/2014 | |
| KR | 20140137533 | A | * | 12/2014 | B63H 25/42 |
| KR | 20140137533 | A | | 12/2014 | |
| KR | 101497397 | B1 | * | 3/2015 | B63H 25/42 |
| KR | 101497397 | B1 | | 3/2015 | |
| WO | 2011/127987 | A1 | | 10/2011 | |
| WO | 2011127987 | A1 | | 10/2011 | |
| WO | 2013/135858 | A1 | | 9/2013 | |
| WO | 2014157999 | A1 | | 10/2014 | |
| WO | 2014182132 | A1 | | 11/2014 | |

* cited by examiner

RETRACTABLE THRUSTER SYSTEM

CROSS-REFERENCE TO RELATED APPLICATIONS

This application is a U.S. National Stage application under 35 U.S.C. § 371 of International Application PCT/NL2016/050712 (published as WO 2017/065614 A1), filed Oct. 17, 2016 which claims the benefit of priority to Application NL 2017249, filed Jul. 28, 2016 and to Application NL 2015624, filed Oct. 15, 2015. Benefit of the filing date of each of these prior applications is hereby claimed. Each of these prior applications is hereby incorporated by reference in its entirety.

The invention relates to a retractable thruster system.

Retractable thruster systems are widely used on vessels, for example in propulsion systems and dynamic positioning systems, i.e. systems to maintain a vessel above a given subsea location and in a given orientation in spite of environmental forces acting upon the vessel. These thrusters need to be retracted in certain circumstances to decrease the vessel's resistance, for example during high speed cruising, or in shallow water, for example when entering a harbour. The thrusters can also be further retracted and elevated into the hull or even onto a vessel's deck for service and maintenance purposes. Thereto, a retractable thruster system, as for example disclosed in U.S. Pat. No. 6,439,936 or in WO2013/135858, generally comprises a canister or frame to which the thruster is mounted. The canister is vertically movable in a vessel's trunk by a lifting mechanism coupled between the canister and the hull to move the canister between a deployed or extended position of the thruster, in which the thruster extends below the hull structure and can be operated, and at least one retracted position, in which the thruster is retracted into the hull, to a position at least just above the hull's bottom, so either below the vessel's floating line or even above the vessel's floating line. It is generally known that such retractable thruster systems comprise a fixation and/or stabilization system to fixate the canister within the trunk, especially in the extended position of the thruster in order to transfer thrust loads and overturning moments from a thruster in operation onto a vessel's hull structure. Such a fixation system usually comprises a number of pins or spindles extending from the canister towards the hull structure such that the canister is clamped in the trunk. The extended pins apply a static load onto the hull structure. A problem with such a prior art retractable thruster system is that the fixation system requires a high number of components to perform the clamping of the canister in the trunk, for example several pins, hydraulic motors and sometimes even quite space-requiring gearboxes. Active control to continuously power and monitor the fixation system, for instance the actual location of the pins, therefore becomes difficult, expensive and space-consuming. Moreover, more active components increase the risk of failure of the system. Another issue with such a prior art system is that the forces applied by the pins or spindles on the hull structure are static forces and do not take into account hull deformations, such as sagging and hogging induced by waves and/or vessel loading. As this deformation can increase up to approximately 5 mm in a trunk for an offshore size canister, and as the pins are only statically loaded, such hull deformations can result in a loss of contact at certain points between the pins or spindles and the vessel's hull. Still a further problem of a prior art retractable thruster system lies in the relatively high forces that may be exerted on the lifting mechanism, and may even damage the lifting mechanism, in case of an even slight accidental shift of the canister in the trunk.

It is an object of the invention to solve or at least alleviate one or more of the above-mentioned problems. In particular, it is an object of the invention to provide an improved retractable thruster system with a reduced number of active components. It is a further aim of the invention to provide a reliable retractable thruster system requiring relatively limited monitoring. Another object of the invention is to provide a safe retractable thruster system ensuring transfer of thrust load substantially at all time during operation of the thruster. The invention also aims at providing a robust retractable thruster system which is able to absorb accidental forces to prevent damage to the system.

To these aims, according to a first aspect of the present invention, there is provided a retractable thruster system characterized by the features of claim 1. In particular, there is provided a retractable thruster system for moving a thruster on a vessel between an extended position, in which the thruster is extended below a hull's bottom, and at least one retracted position, in which the thruster is located above the hull's bottom, the system comprising a canister to which a thruster is mountable, wherein the canister is configured to be movable in a trunk in a vessel's hull structure between said extended position and said at least one retracted position, wherein the canister is arranged to provide frictional contact between at least one canister contact surface on said canister and at least one corresponding trunk contact surface on the trunk when the thruster is in said extended position in order to transfer thrust load from the thruster in operation onto the vessel's hull structure. A shape of the at least one canister contact surface corresponds to a shape of the trunk contact surface, such that the frictional forces which are built up between a canister contact surface and said trunk contact surface when the thruster is in the extended position provide fixation of the canister in the trunk. At the same time, the thrust load, i.e. reaction forces of the thruster in operation, is transferred into the vessel's hull structure efficiently. This is achieved without the need for a high number of separate fixation pins between the canister and the trunk, which have to be individually positioned and controlled, thus providing a retractable thruster system which is relatively easy to manufacture and to control, and therefore saves building and maintenance costs.

The retracted position can comprise numerous positions, among others inside the hull and/or above the deck. The retracted position can be any position in which the thruster is above the hull's bottom, meaning that an underside of the thruster is above the hull's bottom such that the thruster does not extend outside of the hull, which may be preferably e.g. when sailing or in shallow waters etc. The retracted position may also be a position in which the thruster is retrieved above the deck surface, and any position in between this retrieved position and the aforementioned retracted position.

In a preferred embodiment of the invention, the at least one canister contact surface may comprise a substantially frustoconical contact surface arranged to provide frictional forces and compressive forces between said at least one canister contact surface and said at least one corresponding trunk contact surface. The canister may for example comprise at least one substantially frustoconical contact surface, for example on an inwardly bevelled edge close to a bottom side of the canister. Said canister may comprise a locally bevelled edge or may comprise a bevelled edge surrounding the canister. The at least one corresponding trunk contact surface may for example comprise a substantially frustoconical contact surface extending inwardly and downwardly narrowing into the trunk. The frustoconical shape of the canister contact surface and of the at least one corresponding trunk contact surface allow for a combination of frictional and compressive forces between said at least one canister contact surface and said at least one corresponding trunk contact surface improving the fixation of the canister in the trunk.

In a more preferred embodiment, the at least one canister contact surface may comprise a substantially horizontal contact surface arranged to provide substantially horizontal frictional forces between said at least one canister contact surface and said at least one corresponding trunk contact surface. A substantially horizontal contact surface is understood to be a contact surface substantially in parallel with a water surface when the vessel floats. Such a substantially horizontal contact surface of the canister, and consequently a corresponding substantially horizontal trunk contact surface can provide frictional forces while avoiding that the canister might get stuck in the trunk because of too high compressive forces.

In a still more preferred embodiment, the at least one canister contact surface comprises a substantially vertical contact surface arranged to provide compressive forces between said canister and said trunk. Substantially vertical is understood to be transverse to substantially horizontal as defined above. In case of a sudden shock in the vessel, for example due to an accident, frictional forces between a canister and a trunk might get lost. A substantially vertical contact surface between said canister contact surface and said corresponding trunk contact surface may then take over load transfer from the canister to the trunk based on compressive forces between said canister contact surface and said trunk contact surface. The canister may comprise a combination of a frustoconical, horizontal and vertical contact surface, for example in a canister recess extending substantially horizontally and inwardly from a bottom area of a canister's wall, also providing a substantially vertical contact area, of which an edge, for example on a side towards the hull's bottom, is provided with a substantially frustoconical contact area for example extending inwardly and downwardly narrowing. Consequently, the corresponding trunk contact surface may also comprise a combination of a frustoconical, horizontal and vertical contact surface, for example in a contact surface extending substantially horizontally and inwardly from a trunk's inner wall, also providing a substantially vertical contact area, of which an edge, for example on a side towards the hull's bottom, is provided with a substantially frustoconical contact area for example extending inwardly and downwardly narrowing into the trunk.

Said at least one canister contact surface is preferably arranged in a bottom area of the canister, i.e. near a bottom of the hull structure when the thruster is in an extended position. Said location can provide a short line of force between the thruster in operation and the vessel's hull structure, on which the thruster load is transferred. Moreover, it may be sufficient to adapt the trunk contact surface to a lighter underwater weight of the canister.

In an advantageous embodiment of the invention, the retractable thruster system can further comprise a pressure unit arranged to increase the pressure of the canister onto said at least one trunk contact surface. The pressure unit can include a hydraulic pressure unit or a mechanical pressure unit. The exerted pressure on the canister may be constant, or may be adjustable, for example to meteorological circumstances. Increased pressure leads to increased frictional forces between the canister contact surface and the trunk contact surface, providing an improved fixation of the canister in the trunk. Alternatively, instead of, or in combination with, using a pressure unit, frictional forces between the canister and the trunk may be increased by increasing the canister's weight pushing on the trunk contact surface.

Said pressure unit can for example be arranged to pull the canister onto said at least one trunk contact surface. Such a pressure unit can for instance be located on the trunk and be arranged to pull a top side of the canister down onto the trunk contact surface. Such a pulling pressure unit can be a rather compact pressure unit, as the unit does not require a supplementary structure on a top side of the canister.

Alternatively, said pressure unit can preferably be arranged to push the canister onto said at least one trunk contact surface. A pushing pressure unit can for example be arranged on a canister top area, or on the vessel's hull structure, creating a connection between said hull structure and said canister such as to increase the canister's pressure on the trunk contact surface while pushing off from the vessel's hull structure, for example from the trunk. Such a pushing pressure unit may be more easily accessible and/or easier to install in comparison with a pulling pressure unit.

In an advantageous embodiment, said pressure unit can comprise an articulated arm movable between a disengaged position, and an engaged position in which the canister is pushed onto the trunk contact surface. The articulated arm can for example exert a mechanical and/or hydraulic pressure on the canister. Such an articulated arm can be easily operated and controlled.

In a more advantageous embodiment, the arm of said pressure unit is articulated in such a way that the arm of the pressure unit is blocked in an engaged position without application of an external force on said arm. A pressure unit provided with such an articulated arm, which may constitute an invention on its own, can provide pressure in a very economical way, as no energy supply is needed to maintain the arm in the engaged position in which the canister is pushed onto the trunk contact surface. The articulated arm can for example comprise a dead point, beyond which point the articulated arm cannot be brought back without application of a force. In this way, the articulated arm can be easily blocked. In addition, as such a pressure unit does not need active components to be maintained in an engaged position, it is relatively insensitive to possible errors or failures of the system.

Said pressure unit may advantageously comprise an actuator arranged to move said articulated arm from an disengaged position into an engaged position, or from an engaged position into a disengaged position. Such an actuator may for example be an hydraulic actuator, or any other actuator known to a person skilled in the art. The actuator provides the force needed to move the articulated arm of the pressure unit between said disengaged position and said engaged position, and vice versa, for example passing beyond a dead point of the articulated arm, which passing requires more force than moving the arm before or after the dead point.

It is preferred that an inner wall of the trunk can comprise an engagement element arranged to receive a first end of said articulated arm in an engaged position. Such an engagement element provides a support element from which the articulated arm can push itself off to build up pressure.

Advantageously, the pressure unit can comprise an elastic element arranged to push the canister onto said at least one trunk contact surface. Such an elastic element may for example comprise an elastomer, a spring, a rubber, or any other suitable element known to a person skilled in the art.

Said element may comprise a pressure block, for example a rubber block, or for example a pack of spiral springs or blade springs. Pressing an elastic element, such as for example a rubber block, on the canister, which is generally made of steel, ensures a good grip and a high transfer of pressure on the canister, as an elastic element is less sensitive to play than for example steel. By pressing an elastic element on the canister, some misalignment between different components can be allowed without overloading components in the load path. In this way, the compressive force on the canister can efficiently vary within set limits over a longer range of distance of compression than in systems without an elastic element.

In a preferred embodiment of the invention, the retractable thruster system may further comprise a lifting system arranged to move the canister in the trunk between said extended position and said at least one retracted position. Such a lifting system can for example be a hydraulic lifting system or a mechanical lifting system, or any other suitable lifting system.

In a more preferred embodiment, the lifting system can comprise a rack-and-pinion lifting system, including at least one rack being fixedly connected to the vessel, and a pinion drive including at least one pinion arranged to cooperate with said at least one rack, said pinion drive being connected to the canister. A rack-and-pinion lifting system provides a reliable lifting system for moving the thruster and the canister in the trunk of a vessel's hull structure. The rack can also be fixedly connected to the canister, with the pinion drive being connected with the hull structure, for example with the trunk. An alternative lifting system may be a hoisting system or a pin-lock system, or any other lifting system.

In a more preferred embodiment, the pinion drive comprises an upper part and a lower part, the lower part being fixedly connected to the canister and being movably connected with said upper part such that said lower part is movable in a plane transverse to an axial direction of the at least one pinion. A rack-and-pinion system including such a two-part pinion drive, which may constitute an invention on its own, can allow a movement of the canister, fixedly connected to the lower part of the pinion drive, with respect to the vessel. Such a movement, especially when transverse to the axial direction of the pinion, may put a lot of stress on the pinions and even damage a pinion's drive train. Allowing such a movement by a two-part pinion drive can prevent such stress on the pinions.

Advantageously, the lower part of the pinion drive is connected to the upper part of the pinion drive via a double linkage. The double linkage may for example comprise a parallelogram linkage including two connection plates, each being hingedly connected with the upper part and with the lower part of the pinion drive, providing a robust yet simple double linkage. The double linkage may further include a protection plate arranged to limit a movement of the lower part of the pinion drive in a plane transverse to an axial direction of the at least one pinion, in order to avoid contact between said lower part and the upper part of the pinion drive.

It may also be preferred that the lower part of the pinion drive can comprise a locking pin arranged to block the canister in the extended position or in the at least one retracted position. The locking pin may for example be received in a corresponding hole in the rack, so as to block the canister in the desired position, providing a supplementary hold of the canister, for example when the thruster is in operation, and/or providing a partial relief of the load on the rack, for example in a retracted position of the canister.

It may be advantageous that the pinion drive comprises at least one guiding plate to guide a vertical movement of the canister in the trunk. A guiding of the canister movement in the trunk may prevent damage to the rack in case of sudden unexpected movements of the vessel.

According to a second aspect of the invention, there is provided a retractable thruster system according to the features of claims 21-32, leading to one or more of the advantages described above.

In a preferred embodiment of the second aspect of the invention, the at least one trunk contact surface is arranged on at least one canister support structure provided on the trunk. Said canister support structure may for example comprise a structure extending from a trunk's inner wall inwardly into the trunk. The trunk may comprise a single canister support structure, which may be surrounding the trunk, or a plurality of canister support structures along the trunk's inner wall. Such a canister support structure can be easily built separately, and be mounted and adjusted to a canister when the canister is present in the trunk, simplifying the precision work.

Said at least one canister support structure is preferably located in a bottom area of the trunk. Said location can provide a short line of force between the thruster in operation and the vessel's hull structure, on which the thruster load is transferred. Moreover, it may be sufficient to adapt the canister support structure to a lighter underwater weight of the canister.

According to a third aspect of the invention, there is provided a retractable thruster system according to the features of claims 33-34, leading to one or more of the advantages described above.

According to a fourth aspect of the invention, there is provided a vessel provided with at least one retractable thruster system according to the features of claim 35, leading to one or more of the advantages described above.

According to a fifth aspect of the invention, there is provided a pressure unit for a retractable thruster system according to the features of claims 36-40, leading to one or more of the advantages described above.

According to a sixth aspect of the invention, there is provided a rack-an-pinion system for moving a canister between an extended position, in which a thruster is extended below a hull's bottom, and at least one retracted position, in which the thruster is located above the hull's bottom, according to the features of claims 41-44, leading to one or more of the advantages described above.

According to a seventh aspect of the invention, there is provided a method for fixating a canister in a trunk of a vessel's hull according to the features of claims 45-47, leading to one or more of the above described advantages.

A further aspect of the invention may be a canister for moving a thruster on a vessel between an extended position, in which the thruster is extended below a hull's bottom, and at least one retracted position, in which the thruster is located above the hull's bottom, wherein the canister is arranged to receive a thruster, wherein the canister is configured to be movable in a trunk in a vessel's hull structure between said extended position and said at least one retracted position, wherein the canister is arranged to provide frictional contact between at least one canister contact surface on said canister and at least one corresponding trunk contact surface on the trunk when the thruster is in said extended position in order to transfer thrust load from the thruster in operation onto the vessel's hull structure.

Another aspect of the invention relates to a trunk for mounting in a vessel's hull, wherein the trunk is arranged to receive a canister which is movable between an extended position, in which a thruster mounted to the canister is extended substantially below a hull's bottom and at least one retracted position in which the thruster is retracted above the hull's bottom, wherein the trunk is arranged to provide frictional contact between at least one canister surface on said canister and at least one trunk contact structure on the trunk when the thruster is in said extended position in order to transfer thrust load from the thruster in operation onto the vessel's hull structure.

Another aspect of the invention relates to the system of canister and a trunk and/or may relate to a kit of a canister and a trunk.

The present invention will be further elucidated with reference to figures of exemplary embodiments. Corresponding elements are designated with corresponding reference signs.

Figure 1:
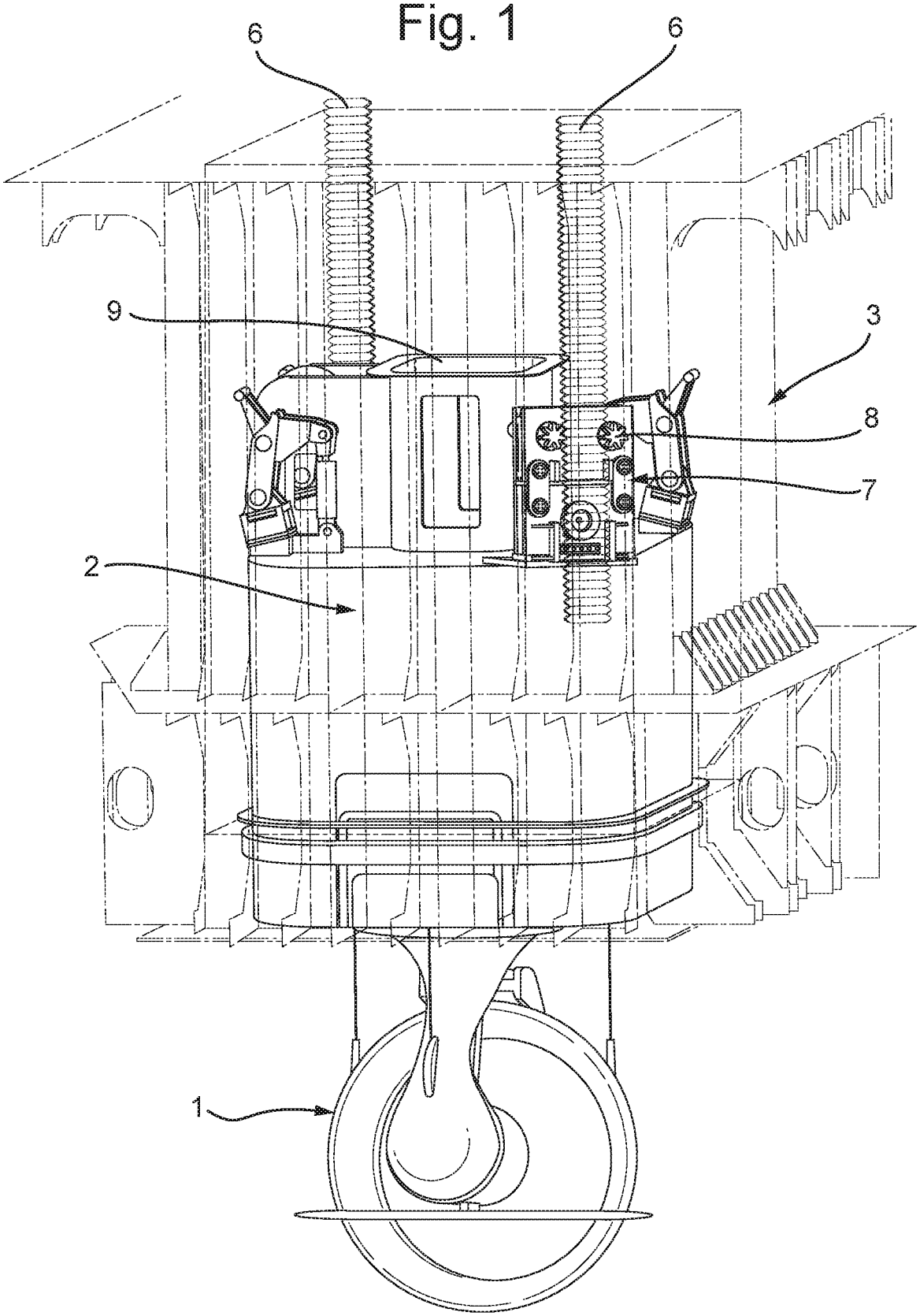
FIG. 1 shows a perspective view of a preferred embodiment of a retractable thruster system according to an aspect of the invention.
Figure 3A:
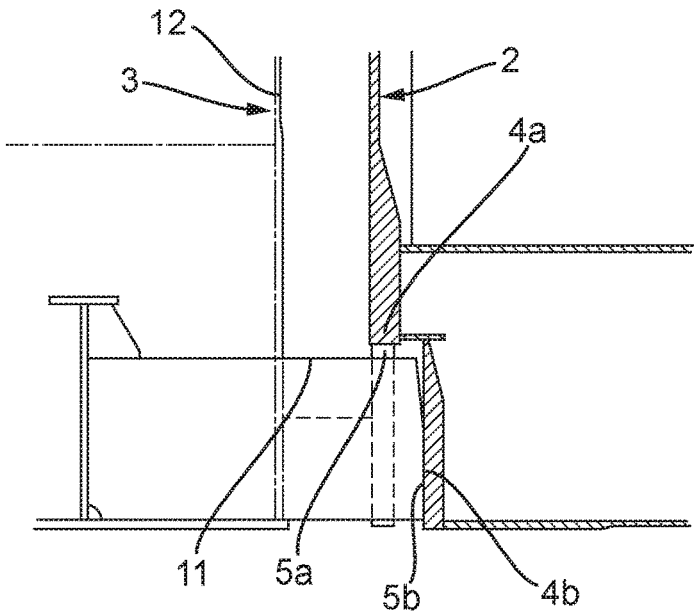
Figure 3B:
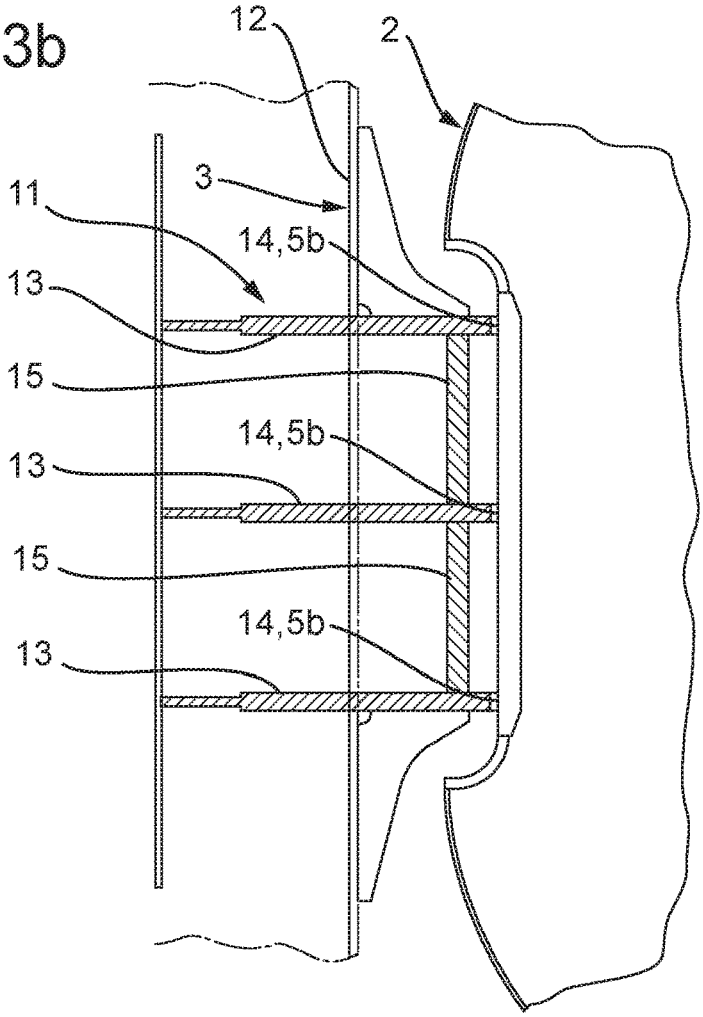
Figure 4:
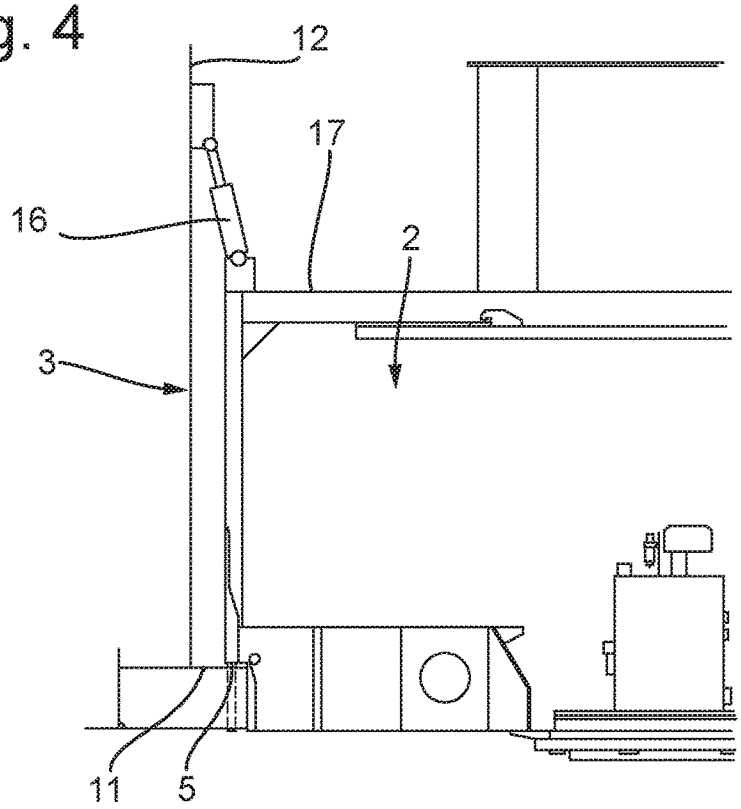
Figure 5:
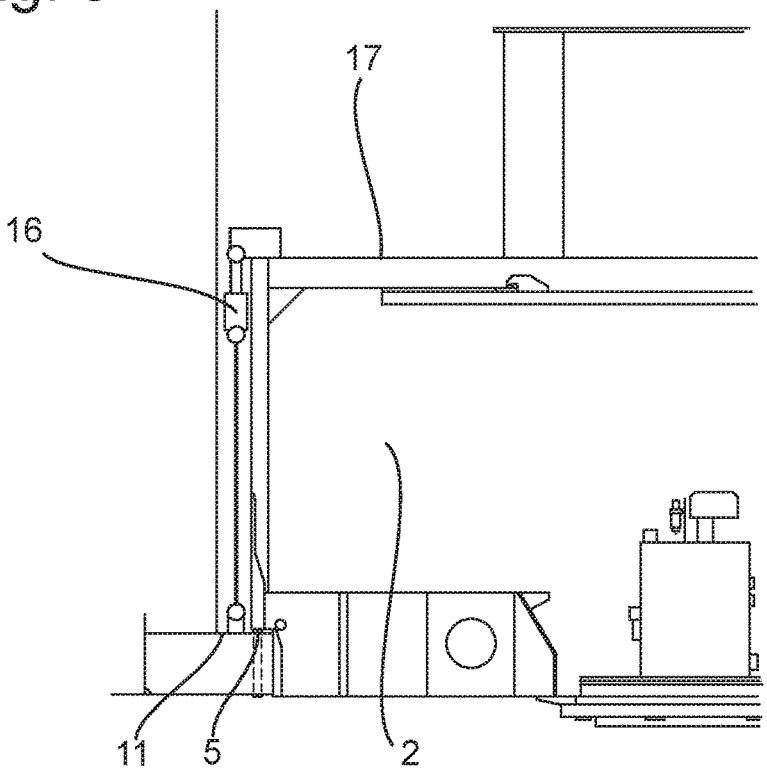
Figure 6:
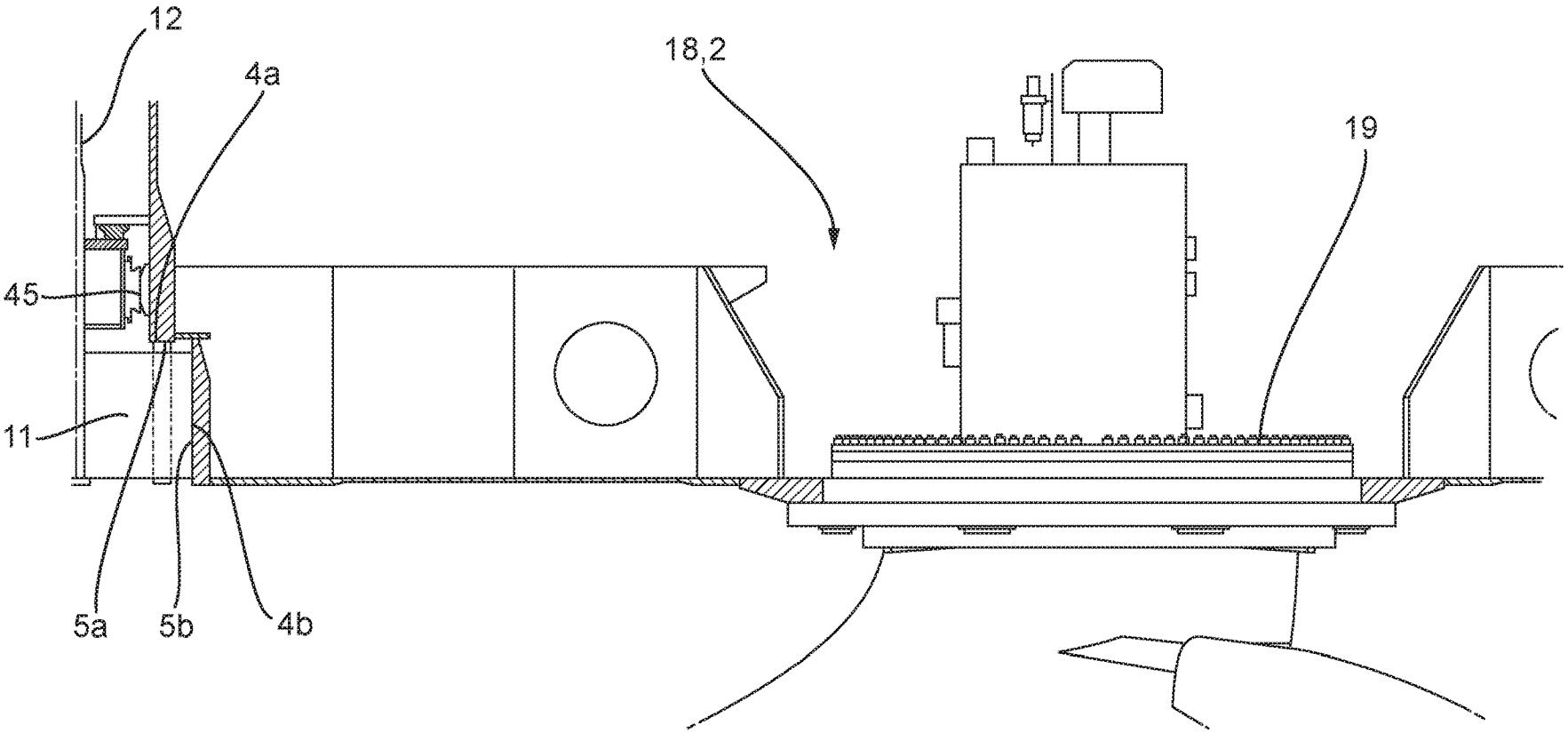
Figure 7:
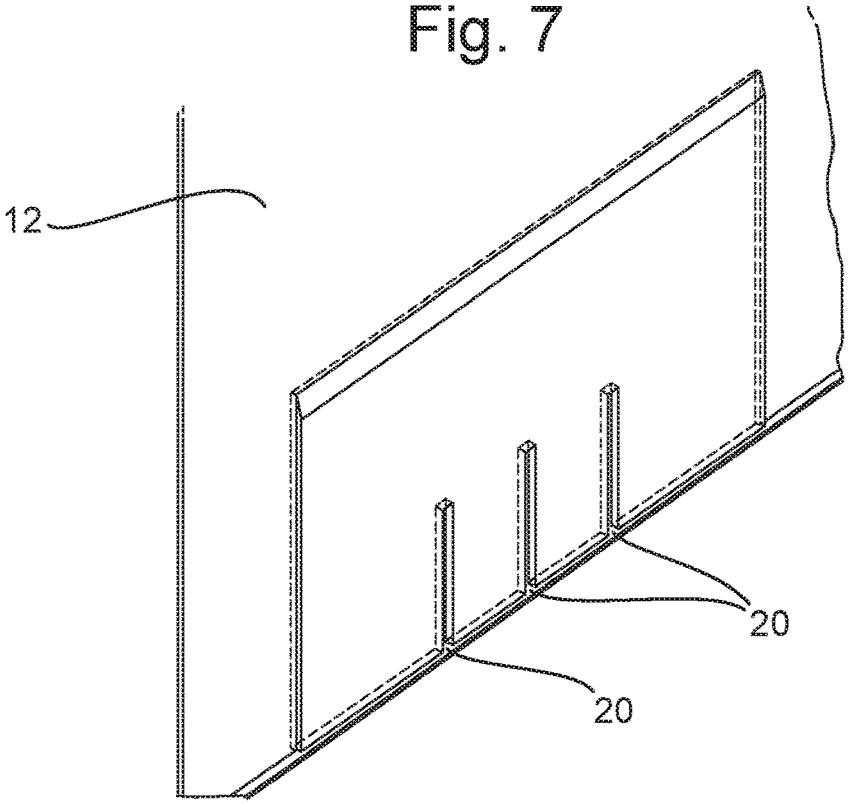
Figure 8:
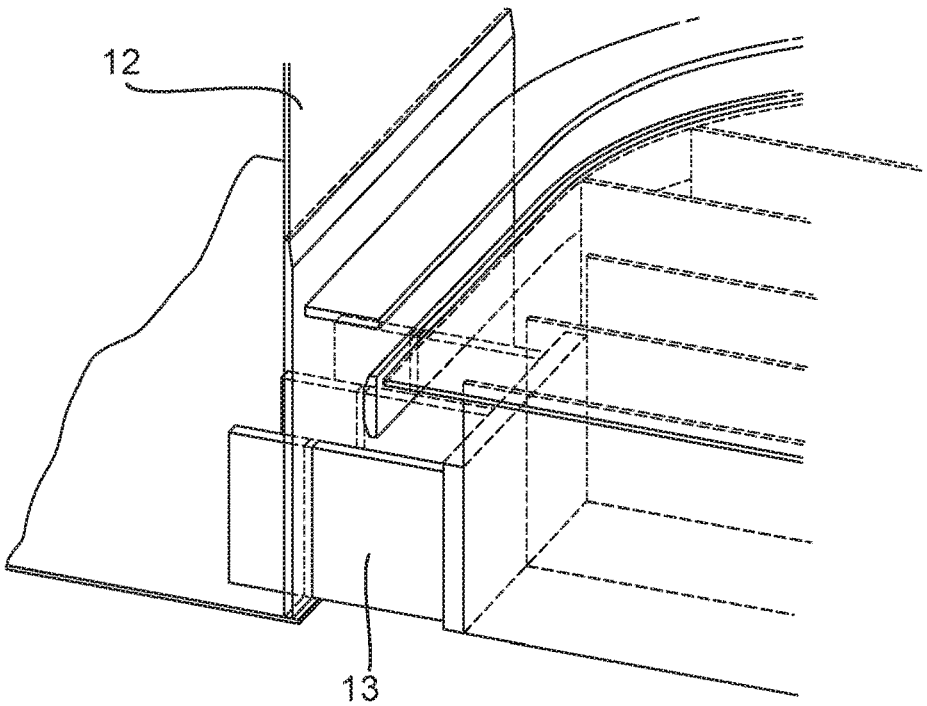
Figure 9:
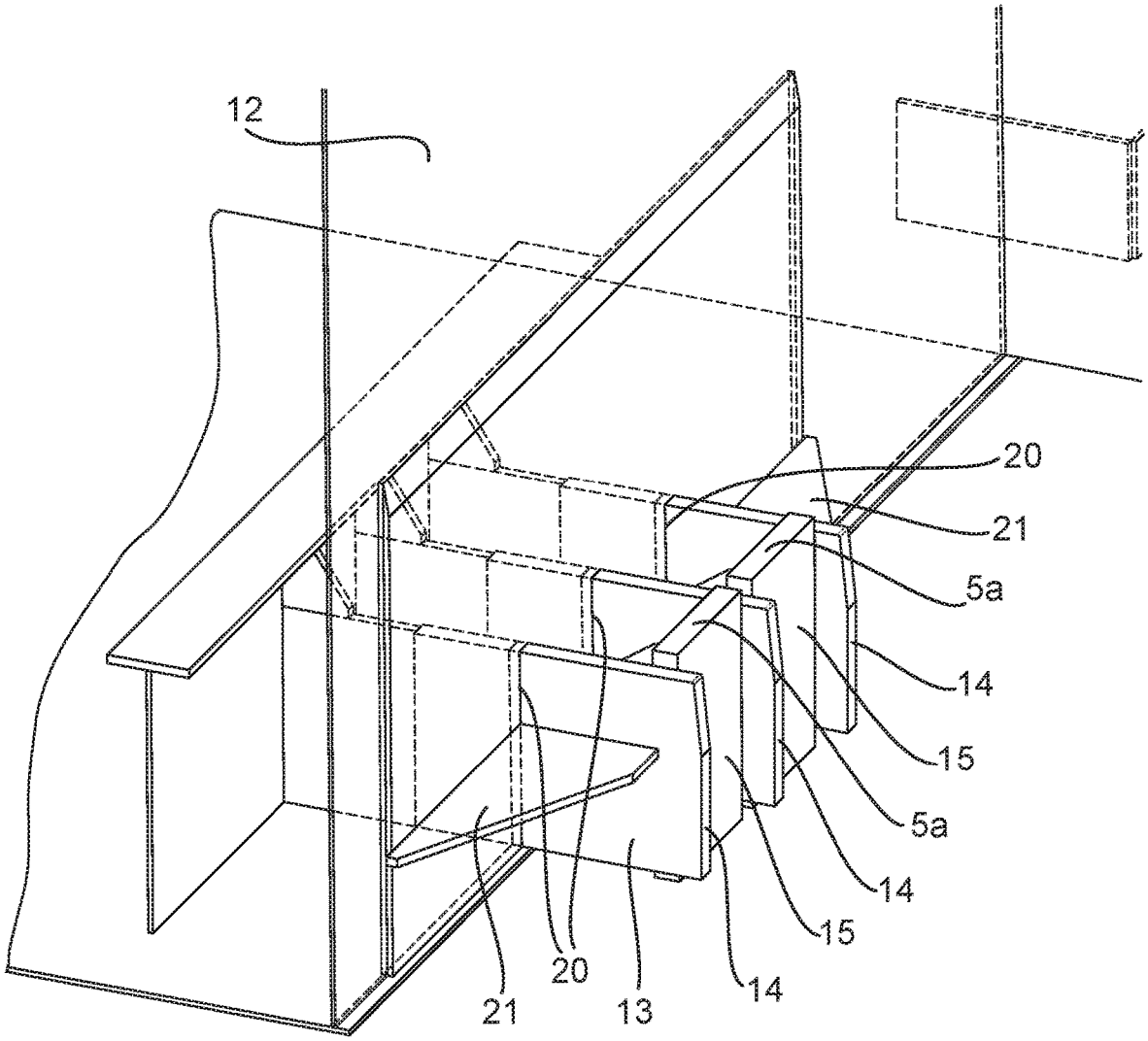
Figure 10:
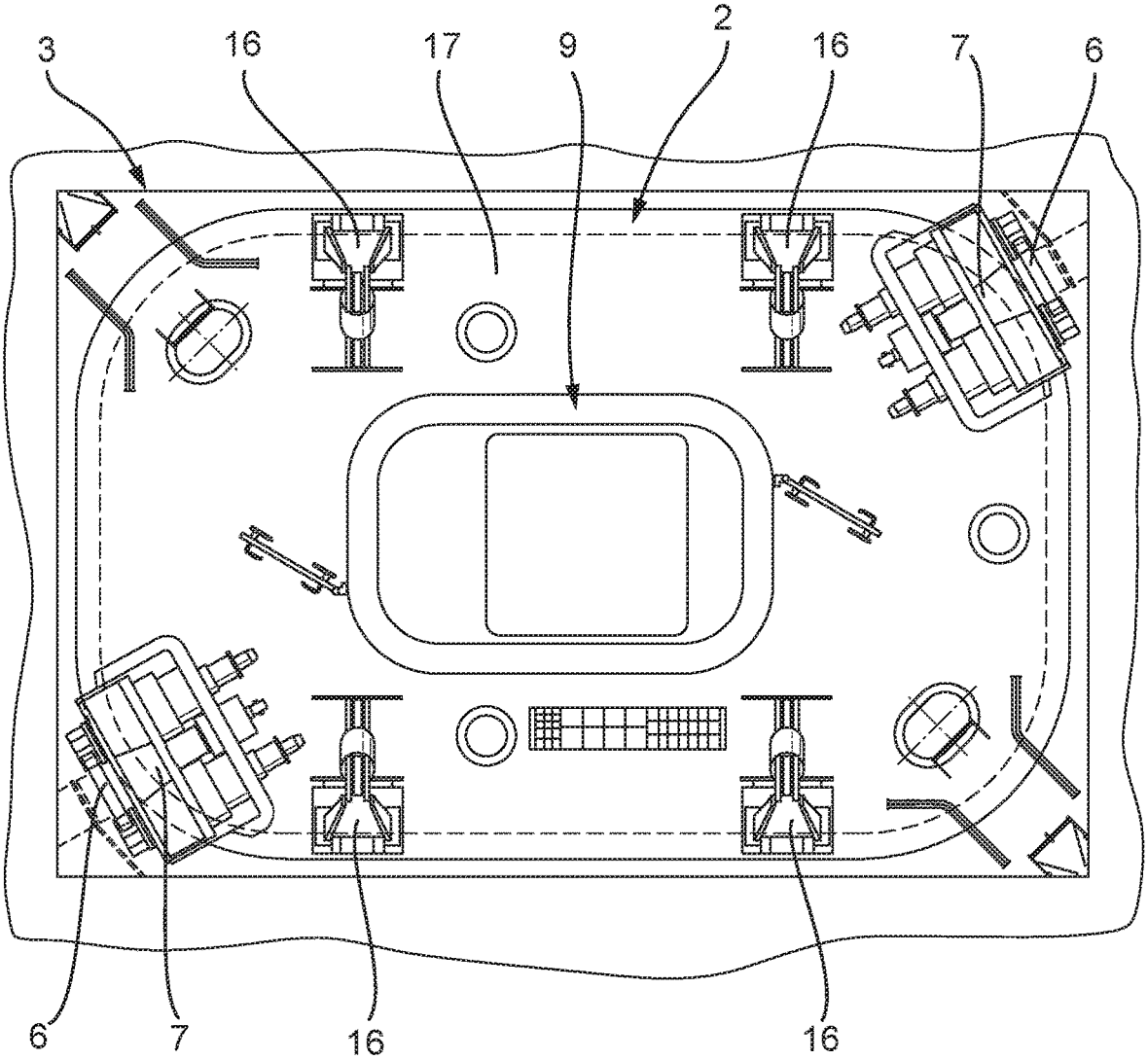
Figure 11:
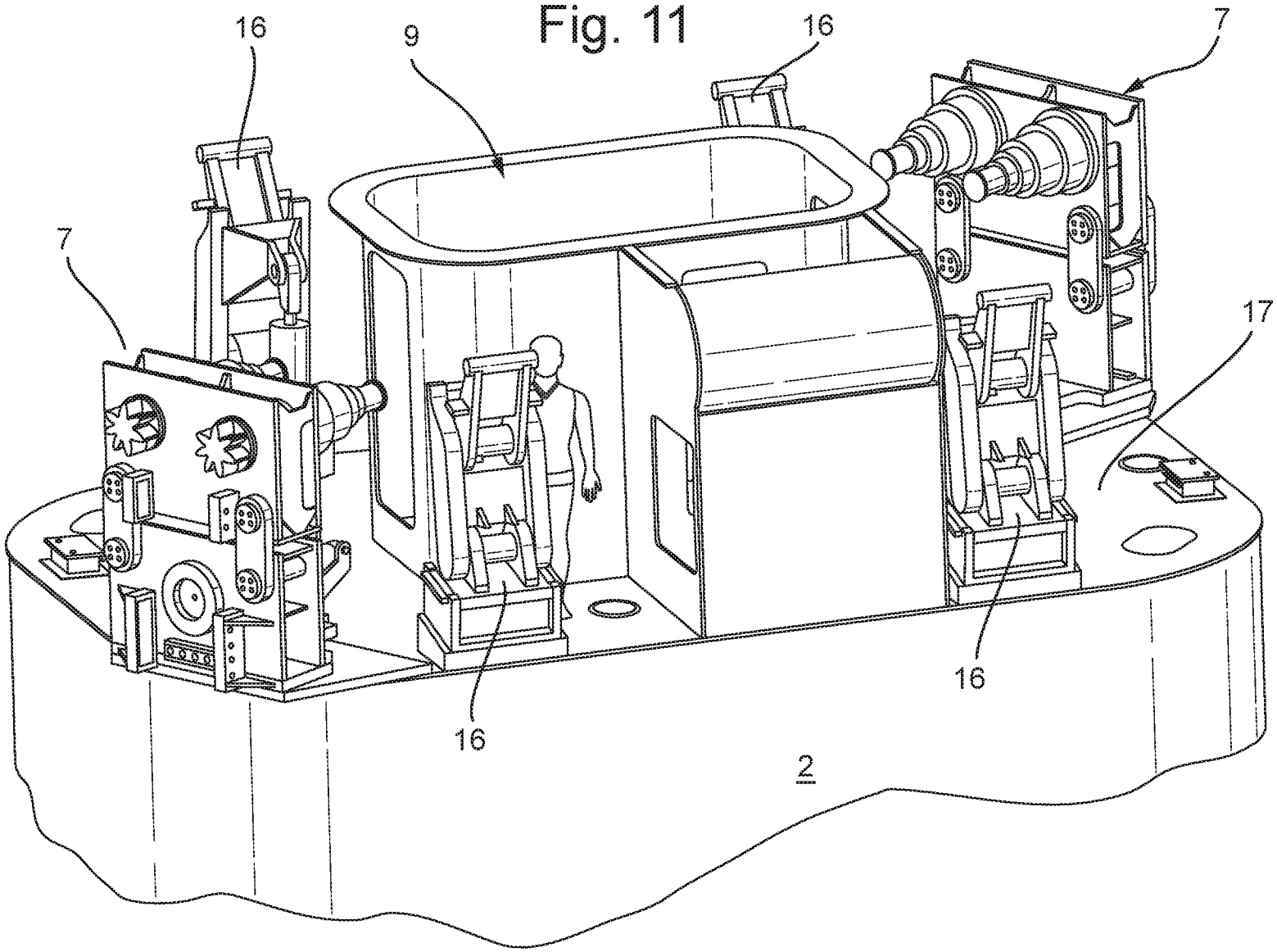
Figure 12:
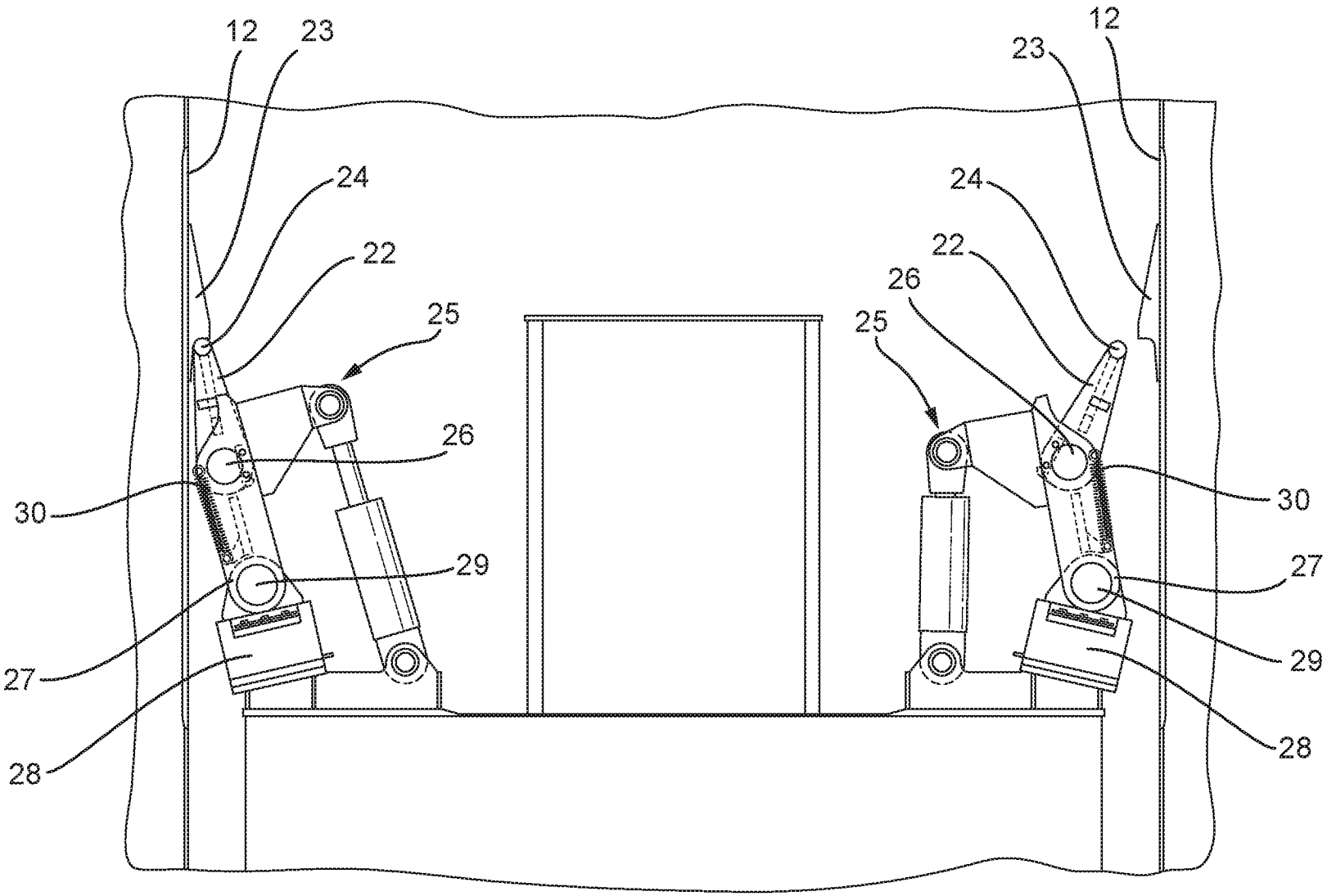
Figure 13:
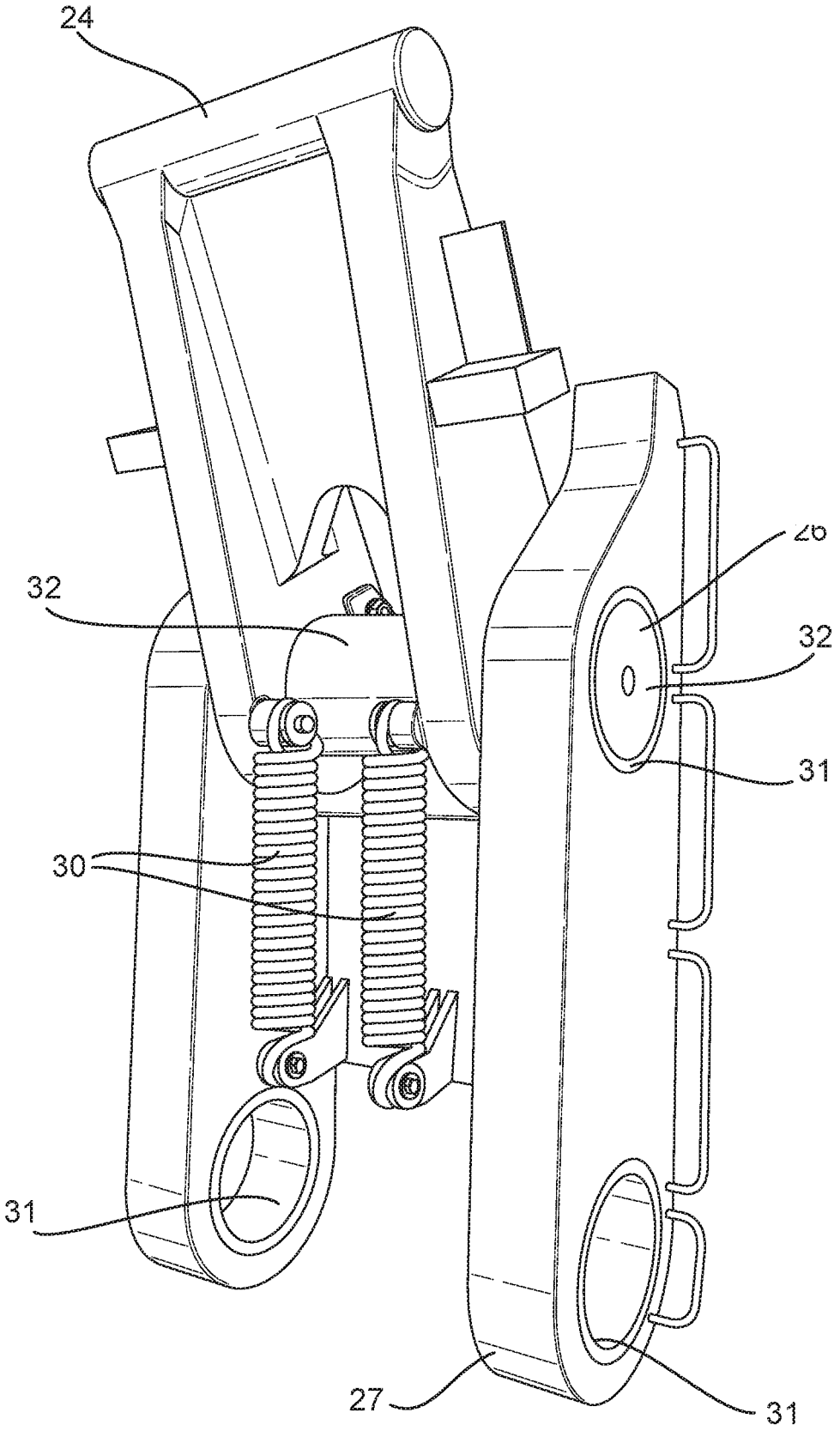
Figure 14:
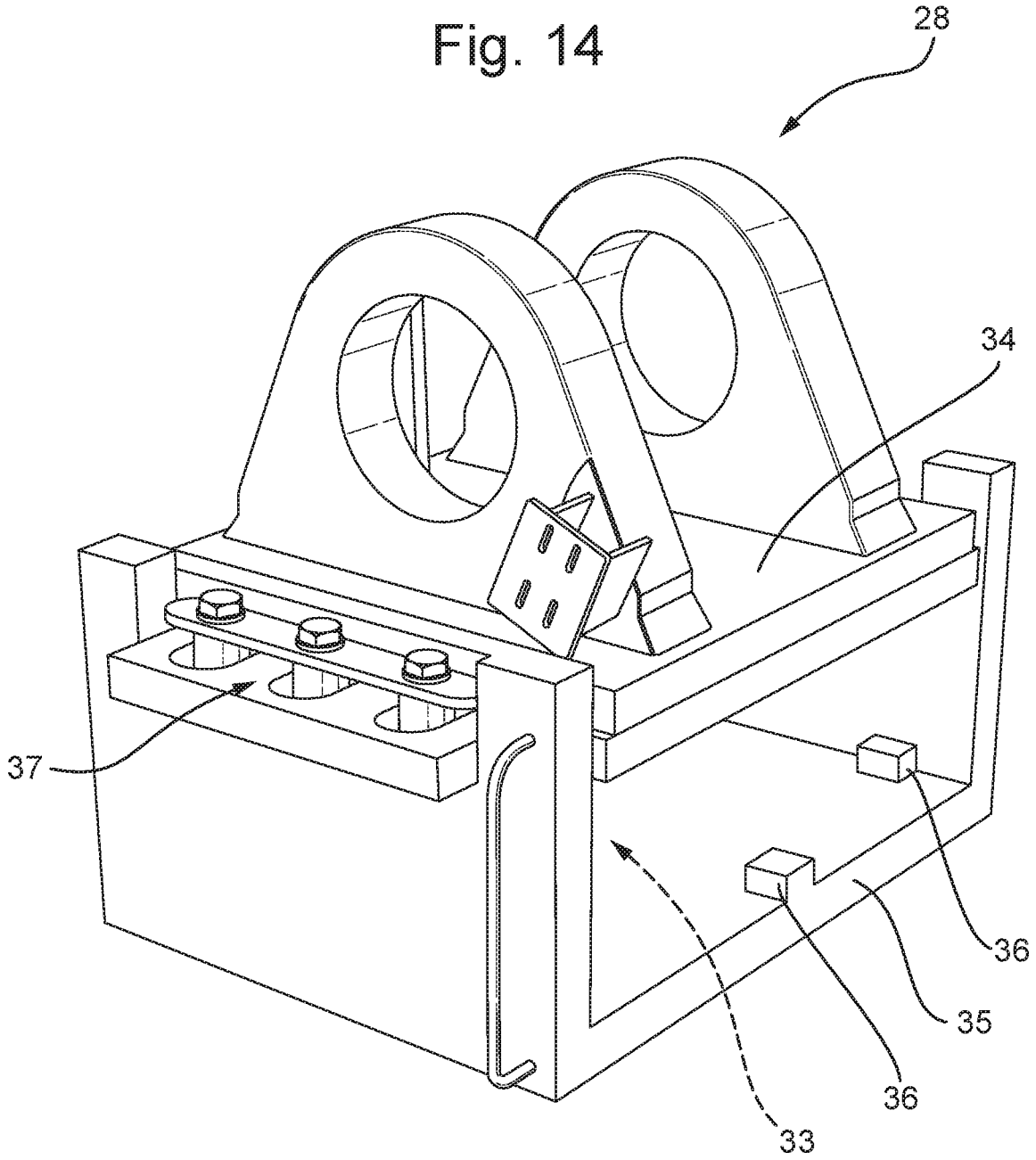
Figure 15:
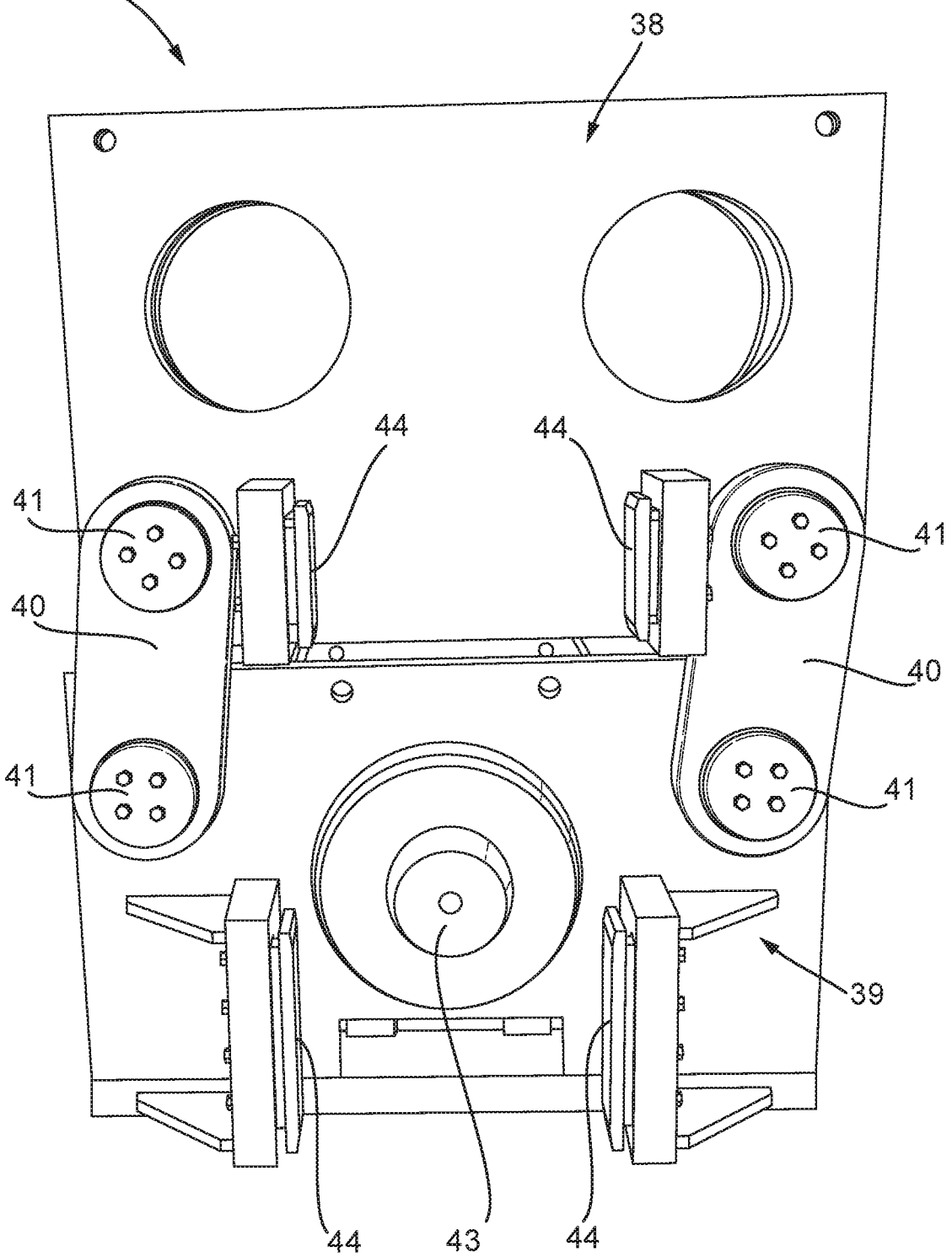
Figure 16:
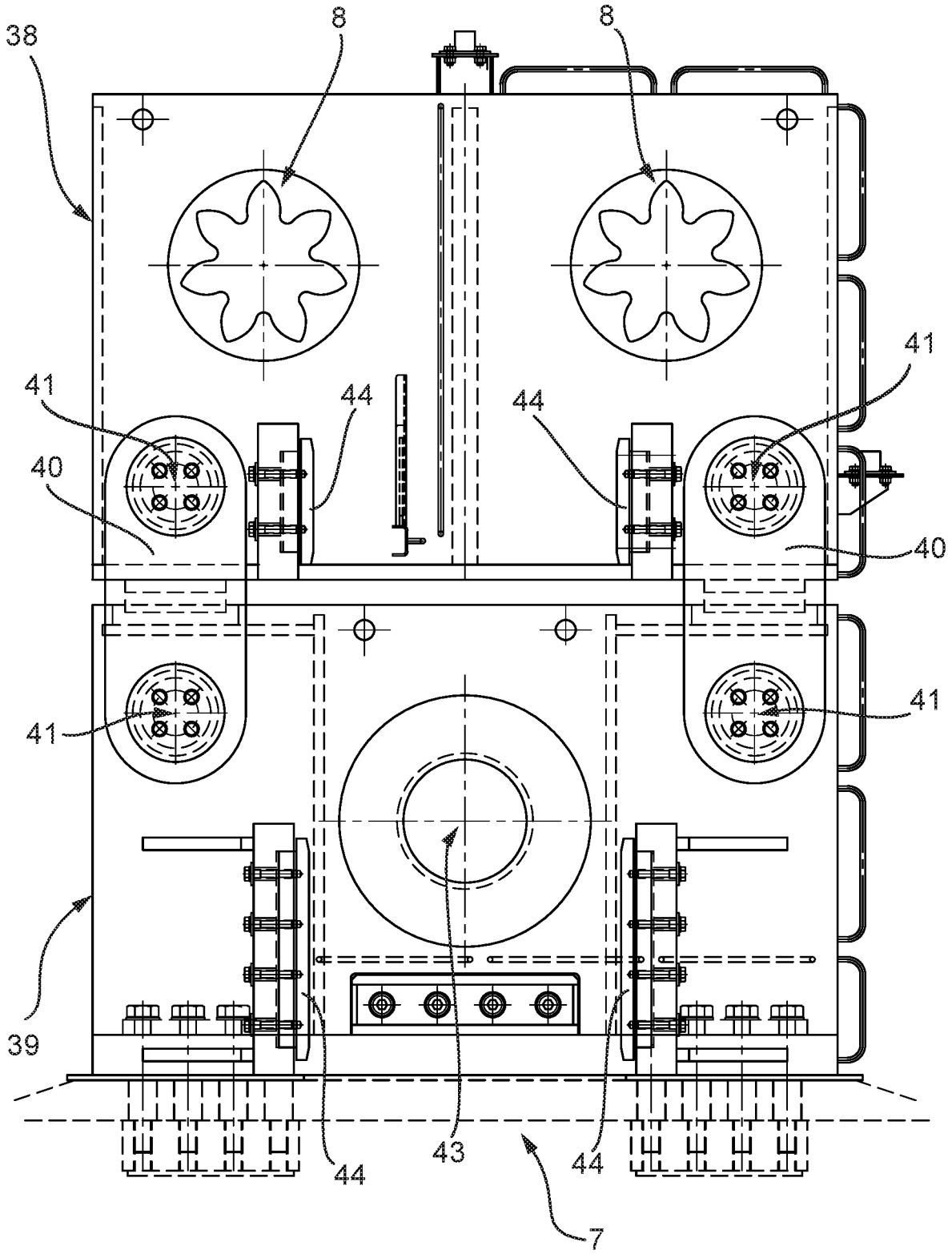
Figure 17:
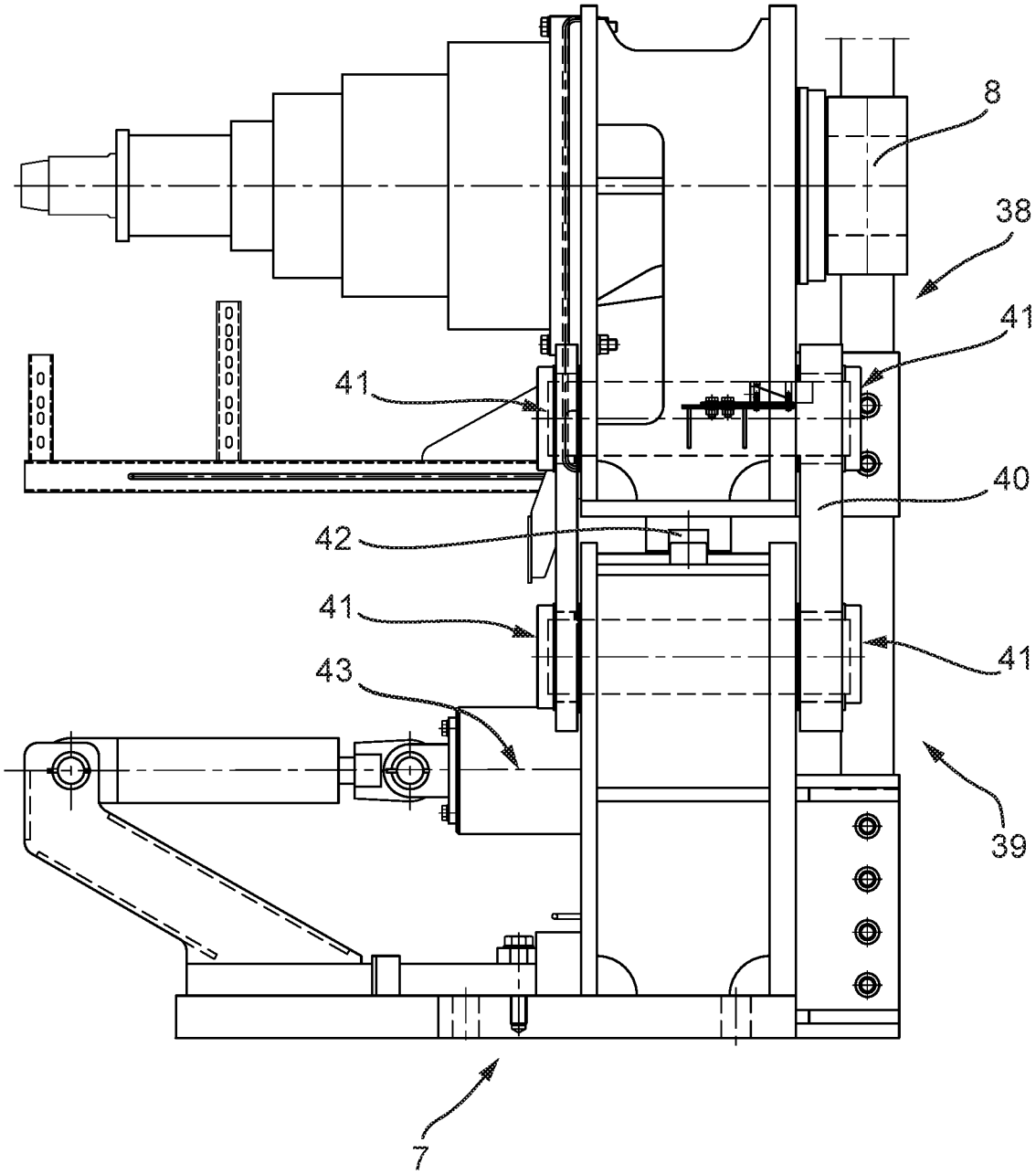

FIGS. 3*a* and 3*b* show a schematic side view and top view respectively of a canister support structure of the retractable thruster system of FIG. 1;

FIG. 4 shows a schematic side view on a retractable thruster system according to a preferred embodiment of the invention comprising a pressure unit;

FIG. 5 shows a schematic side view on a retractable thruster system according to a preferred embodiment of the invention comprising an alternative pressure unit;

FIG. 6 shows a cross-sectional view of a canister's bottom area of the retractable thruster system of FIG. 1;

FIG. 7 shows a perspective schematic view on a trunk's side wall of the retractable thruster system of FIG. 1 before installation of a canister support structure;

FIG. 8 shows a perspective schematic view on a trunk's side wall of the retractable thruster system of FIG. 1 during installation of a canister support structure;

FIG. 9 shows a perspective schematic view on a trunk's side wall of the retractable thruster system of FIG. 1 after installation of a canister support structure;

FIG. 10 shows a schematic top view on a canister of the retractable thruster system of FIG. 1;

FIG. 11 shows a perspective view on a top area of a canister of the retractable thruster system of FIG. 1;

FIG. 12 shows a schematic side view on a preferred embodiment of a pressure unit in an engaged and a disengaged position in the retractable thruster system of FIG. 1;

FIG. 13 shows a perspective view on an articulated arm of a pressure unit in the retractable thruster system of FIG. 1;

FIG. 14 shows a perspective view on a pressure block of a pressure unit in the retractable thruster system of FIG. 1;

FIG. 15 shows a perspective front view of a pinion drive in the retractable thruster system of FIG. 1;

FIG. 16 shows a schematic front view of a pinion drive in the retractable thruster system of FIG. 1;

FIG. 17 shows a schematic side view of a pinion drive in the retractable thruster system of FIG. 1.

FIG. 1 shows a perspective view of a preferred embodiment of a retractable thruster system according to an aspect of the invention. A retractable thruster system generally comprises a canister 2 to which a thruster 1 is mountable. The canister 2 generally contains the machinery needed to operate the thruster 1. The thruster 1, for example a propeller, can extend below a hull's bottom, in which extended position the thruster can be operated, for example as part of a vessel's dynamic positioning system, or as part of a vessel's propulsion system. In some situations, for example in shallow water, or to the contrary, during high speed cruising of a vessel, the thruster may need to be retracted to avoid a high resistance of the thruster in the water. The thruster 1 can be retracted to at least one position located above the hull's bottom. A retracted position of the thruster 1 may be such that the thruster 1 is substantially flush with a hull's bottom, or the thruster 1 may be retracted to a position higher above the hull's bottom, for example to a dry position above the vessel's waterline, or even to a vessel's deck. Thereto, the preferred embodiment of a retractable thruster system of FIG. 1 comprises a lifting system arranged to move the canister 2, preferably vertically, in the trunk 3 between said extended position and said at least one retracted position. The lifting system can for example be a rack-and-pinion lifting system, including at least one rack 6 being fixedly connected to the vessel, in particular to an inner side of the trunk 3 in the vessel's hull structure, and a pinion drive 7 including at least one pinion 8 arranged to cooperate with said at least one rack 6, said pinion drive 7 being connected to the canister 2. The embodiment of FIG. 1 shows two racks on opposite corners of the trunk 3, each rack comprising two sides of teeth, such that each rack is arranged to cooperate with two pinions 8 simultaneously. The lifting system may be arranged to operate in a wet or in a dry environment, depending on whether the canister 2 is sealable in the trunk 3 or not. In case only a limited height is available for the canister 2, it may be desirable to seal the canister 2 in the trunk 3 to avoid continuously exposing equipment, for example on a canister's top area 17, to an offshore environment. In case more height is available, watertight sealing of the canister 2 in the trunk 3 may be applied, but need not, as it may be preferred to have a higher canister 2 such that safe access to a canister's top area 17 can be ensured. The canister 2 can also be sealed in a watertight manner so as to protect the machinery, for example inside a canister, against water, and/or to protect the water against polluting products from the machinery. The machinery in the canister 2 may be accessed through a hatch on a top side of the canister 2, or through a lock access 9, as in FIG. 1. The shape of the canister 2 may vary, depending on the structure of a vessel. The canister 2 of the embodiment of FIG. 1 has for example a rectangular shape with bevelled corners, but the canister 2 can also have a round shape, or a square shape, or any other suitable shape.

Figure 2:
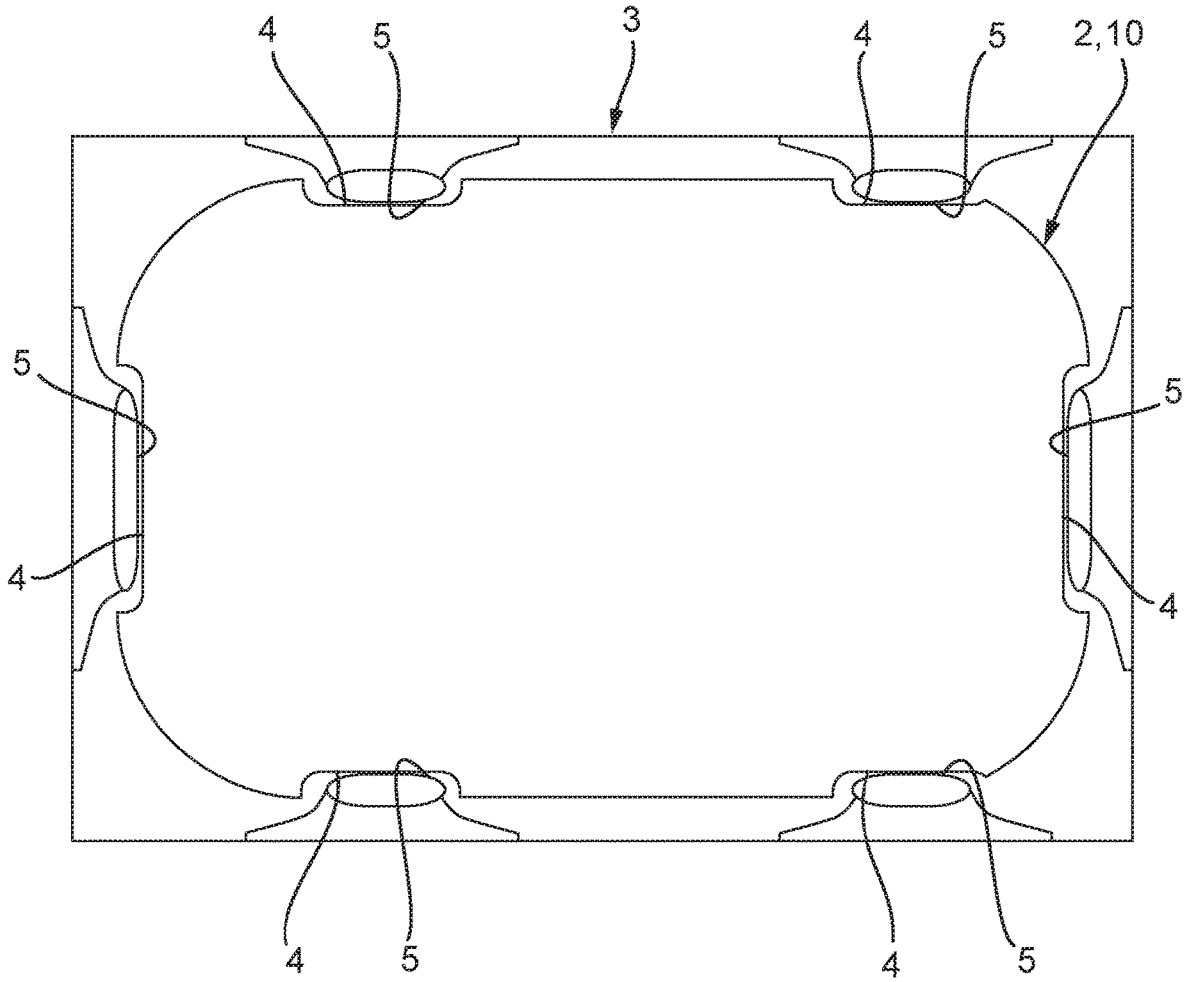
FIG. 2 shows a schematic bottom view of a canister of the retractable thruster system of FIG. 1.

FIG. 2 shows a schematic bottom view of a canister of the retractable thruster system of FIG. 1. In order to stabilize the canister 2 in the trunk 3 during operation of the thruster 1 and in order to transfer thrust load from the thruster 1 in operation onto the vessel's hull structure, for example via the trunk 3, the canister 2 is arranged to provide frictional contact between at least one canister contact surface 4 on said canister 2 and at least one corresponding trunk contact surface 5 on the trunk 3 (see FIG. 3) when the thruster is in the extended position. The frictional contact between the at least one canister contact surface 4 and the at least one trunk contact surface 5 can for example be steel to steel contact, and is preferably of such a level that normal operational loads of the thruster 1 can be transferred by friction only. The canister contact surface 4 and the trunk contact surface 5 can also be a combination of materials to eliminate wear and tear. The canister contact surface 4 can for example be made of NVE 690 steel, and the trunk contact surface 5 for example of Hardox®. The at least one canister contact surface 4 is preferably arranged in a bottom area 18 of the canister 2, which may include a canister's side wall 10 close to a bottom of the canister 2, or the bottom side of the canister 2. In the embodiment of FIG. 2, a bottom side of the canister 2 comprises for example six recesses in a canister's side wall 10, in which recess is located a canister contact surface 4, for example a thickening in a canister wall (see shaded part in FIG. 3*a*) or a thickened supplementary contact plate attached to a canister wall. On the trunk 3, there is provided at least one corresponding trunk contact surface 5 arranged to cooperate with the at least one canister contact surface 4 to provide frictional contact forces between the canister 2 and the trunk 3. In other embodiments, a canister contact surface 4 may for example extend slightly vertically under a bottom side of the canister 2, or may also surround a canister 2, or a canister contact surface 5 may comprise a flange slightly extending outwardly from a canister's side wall. In the preferred embodiment of FIG. 2, the canister 2 may for example comprise a substantially horizontal contact surface arranged to provide substantially horizontal frictional forces between said at least one canister contact surface 4 and said at least one corresponding trunk contact surface 5. At the same time, the canister 2 may for example comprise a substantially vertical contact surface arranged to provide compressive forces between said at least one canister contact surface 4 and said at least one corresponding trunk contact surface 5. Thereto, a bottom area of the canister 2 may for example comprise at least one recess having a horizontal side extending inwardly from a canister's side wall, and a vertical side joining a canister's bottom side. Alternatively, the canister 2 could also be provided with at least one substantially frustoconical contact surface arranged to provide frictional forces and compressive forces between said at least one canister contact surface 4 and said at least one corresponding trunk contact surface 5.

FIGS. 3*a* and 3*b* show a schematic side view and top view respectively of a canister support structure of the retractable thruster system of FIG. 1. In a preferred embodiment of the invention, the at least one trunk contact surface 5 is arranged on at least one canister support structure 11, extending from a trunk's inner wall 12, preferably located in a bottom area of the trunk 3. Each canister support structure 11 can include a plurality of substantially parallel sheet plates 13 reaching through a slit in the trunk's inner wall 12 and extending inwardly into the trunk 3. An inward edge 14 of said sheet plates 13 may provide a substantially vertical trunk contact surface 5*b* arranged to provide compressive forces between said trunk contact surface 5 and said at least one corresponding canister contact surface 4. The canister support structure 11 may further include at least one transverse sheet plate 15, engagingly connecting two substantially parallel sheet plates 13 slightly spaced apart from an inward edge 14 of said substantially parallel sheet plates 13. The at least one transverse sheet plate 15 may extend slightly above the substantially parallel sheet plates 13 thus providing a substantially horizontal trunk contact surface 5*a* arranged to provide substantially horizontal frictional forces between said at least one trunk contact surface 5 and said at least one corresponding canister contact surface 4. It will be clear to a person skilled in the art that such a canister support structure 11 can be made in many different ways. The trunk contact surface 5 can also be integrated in the trunk 3 itself, for instance by adapting the shape of a bottom area of the trunk 3, and can for example also comprise a substantially frustoconical contact surface arranged to provide frictional forces and compressive forces between said at least one trunk contact surface 5 and said at least one corresponding canister contact surface 4.

FIG. 4 shows a schematic side view on a retractable thruster system according to a preferred embodiment of the invention comprising a pressure unit 16. The pressure unit 16 is arranged to increase the pressure of the canister 2 onto said at least one trunk contact surface 5, for example using hydraulic cylinders to generate the required force. The pressure unit 16 can for example be arranged on a canister's top area 17. The pressure unit 16 can for example be arranged to push the canister 2 onto said at least one trunk contact surface 5, for example by generating a pushing force on a canister's top area 17 while pushing off from a trunk's inner wall 12.

FIG. 5 shows a schematic side view on a retractable thruster system according to a preferred embodiment of the invention comprising an alternative pressure unit 16, which can for example be arranged to pull the canister 2 onto said at least one trunk contact surface 5. Thereto, said pressure unit 16 can for example be connected with a canister support structure 11 and engage a canister's top area 17 to generate a force to pull the canister 2 down on the at least one trunk contact surface 5, for example on said canister support structure 11.

FIG. 6 shows a cross-sectional view of a canister's bottom area 18 of the retractable thruster system of FIG. 1. The canister's bottom area 18 includes a thruster connection plate 19 to which the thruster 1 is mountable. When the thruster 1 is operated, the central connection plate transfers load, for example thruster reaction forces, into the canister 2, which load is then further transferred into the vessel's hull structure through the frictional forces between said at least one substantially horizontal canister contact surface 4*a* and said at least one corresponding substantially horizontal trunk contact surface 5*a*. In case the frictional forces are lost between said corresponding substantially horizontal contact surfaces 4*a*, 5*a*, for example due to a sudden shock, load can be transferred from the canister 2 to the vessel's hull structure via compressive contact forces between the at least one canister and trunk contact surfaces 4, 5, for example between the substantially vertical canister and trunk contact surfaces 4*b*, 5*b*, or between an additional and optional vertical support structure 45 extending for example from the trunk's inner wall and arranged to provide compressive contact forces with the canister in case of loss of frictional forces. The initial fixation of the canister 2 is based on friction, and the secondary is based on compressive contact. The canister can be built with normal tolerances, but stricter tolerances may be required to the perpendicularity between the thruster connection plate 19 and the canister 2.

FIG. 7 shows a perspective schematic view on a trunk's side wall of the retractable thruster system of FIG. 1 before installation of a canister support structure 11. In order to avoid precise machining of the trunk 3 and the canister 2, there is provided a method to mount and adjust the at least one canister support structure 11 into the trunk 3. According to this method or building sequence, the hull block structure can first be finished with exception of the canister support structure 11, which is welded to the hull block after final adjustments with the canister 2 in place. A trunk's inner wall 12 is provided with slits 20, for example vertically extending slits preferably in a bottom area of the trunk 3, which are arranged to receive one of said plurality of said substantially parallel sheet plates 13. Said substantially parallel sheet plates 13 can then be inserted into said slits 20. When the canister 2 is lowered down into the trunk 3 (see FIG. 8), the final position of, or the extension of said substantially parallel sheet plates 13 inwardly into the trunk 3, can be adjusted to a size of the canister 2, and can be provisionally fixated to the trunk 3, for example by tack-welding, bolting, riveting or any other suitable connecting technique. The extension into the trunk of said substantially parallel sheet plates 13 can be chosen such that an edge 14 (see FIG. 9) of said substantially parallel sheet plates 13 is only slightly spaced apart from the canister 2, creating an initial gap between the canister 2 and the canister support structure 11, to quickly find a new secondary contact surface providing compressive forces between the at least one substantially vertical contact surfaces on the canister 2 and the canister support structure 11 in case of loss of frictional contact, for example because of abnormal loadings, such as occurring accidental loads.

FIG. 9 shows a perspective schematic view on a trunk's side wall of the retractable thruster system of FIG. 1 after installation of a canister support structure 11. Once the substantially parallel sheet plates 13 have been provisionally connected to the trunk 3, the canister 2 can be retracted or hoisted from the bottom area of the trunk 3 and these sheet plates 13 can be fixedly connected to the trunk 3, for example by welding, or by any other suitable connecting technique. Then, the at least one transverse sheet plate 15 can be adjusted and tack-welded between two of said substantially parallel sheet plates 13, for example while lowering again the canister, before fully fixedly connecting them through for example welding when the canister 2 is again retracted. Additional support brackets 21, for example shims, may be provided to a trunk's inner wall 12 to support a side of said canister support structure 11. The trunk 3 can be easily provided with a plurality of canister support structures 11 following the method depicted in FIGS. 7-9. The number of actually required canister support structures 11 depends for example on the thruster arrangement.

FIG. 10 shows a schematic top view on a canister's top area 17 in the retractable thruster system of FIG. 1 and FIG. 11 shows a perspective view on a top area of a canister's top area 17 of the retractable thruster system of FIG. 1. The canister's top area 17 in this preferred embodiment of a retractable thruster system is provided with two pinion drives 7 each including two pinions 8 of a rack-and-pinion lifting system, and with four pressure units 16, of the type schematically shown in FIG. 4 generating a pushing force on the canister 2. The number of pinion drives 7 and of pressure units 16, as well as their location on the canister's top area, can vary according to the vessel and thruster constraints. A preferred embodiment of the pressure unit 16 will be described in more detail in FIGS. 12-14. The preferred embodiment of the pinion drive 7, as shown here in FIG. 10, will be further disclosed by FIGS. 15-17. An aspect of the invention also provides a method for fixating a canister 2 in a trunk 3 of a vessel's hull. The method comprises movably arranging the canister 2 in the trunk 3 between an extended position, in which the thruster 1 is extended below a hull's bottom, and at least one retracted position, in which the thruster 1 is located above a hull's bottom, providing at least one canister contact surface 4 on the canister 2, providing at least one trunk contact surface 5 on the trunk 3 corresponding to the canister contact surface 4, for example according to the method as described above with FIGS. 7-9, moving the canister 2 with respect to the trunk 3 such that the at least one canister contact surface 4 is in contact with the at least one corresponding trunk contact surface 5 to provide frictional contact between the at least one canister contact surface 4 on said canister 2 and said at least one corresponding trunk contact surface 5 on the trunk 3 when the thruster 1 is in said extended position in order to transfer thrust load from the thruster in operation onto a vessel's hull structure. In a preferred embodiment of the method, the method further comprises the step of a pressure unit 16 pushing the canister 2 onto said at least one trunk contact surface 5, preferably without application of an external force.

FIG. 12 shows a schematic side view on a preferred embodiment of a pressure unit in an engaged and a disengaged position in the retractable thruster system of FIG. 1. The pressure unit 16 comprises an articulated arm 22 movable between a disengaged position, shown on the right-hand side, and an engaged position, shown on the left-hand side, in which the canister 2 is pushed onto the at least one trunk contact surface 5. The trunk's inner wall 12 comprises an engagement element 23 arranged to receive a first end 24 of said articulated arm 22 in an engaged position. The pressure unit 16 also comprises an actuator 25 arranged to move said articulated arm 22 from a disengaged position into an engaged position, or from an engaged position into a disengaged position. Said actuator 25 can for example be a hydraulic actuator, or any other suitable actuator. According to a preferred embodiment of an aspect of the invention, a method for fixating a canister 2 in a trunk 3 of a vessel's hull can comprise the step of activating the actuator 25 to bring or move the articulated arm 22 from a disengaged position into an engaged position, when the canister 2 has reached the extended position in which the thruster 1 can be operated. Once the articulated arm 22 is in an engaged position, the actuator 25 can be deactivated. The arm 22 is articulated in such a way that the arm 22 of the pressure unit 16 is blocked in an engaged position without application of an external force on said arm 22, for example a force of an actuator 25. This is accomplished by pushing a first articulation 26 of the articulated arm 22 beyond a dead point. In the thus reached engaged position, the first end 24 of the articulated arm 22, the first articulation 26 and a second end 27 of the articulated arm 22, which end 27 is hingedly connected with a pressure block 28 at a second articulation 29, are substantially in line and can generate a force pressing down the canister 2 on the at least one trunk contact surface 5, solely thanks to the positioning of the engagement element 23 adjusted to a length of the articulated arm 22 and the blocking of the articulated arm 22 in the engaged position. The actuator 25 is not arranged to exert a vertical pressure on the canister 2 itself.

FIG. 13 shows a perspective view on an articulated arm of a pressure unit in the retractable thruster system of FIG. 1. As the force needed to pass the articulated arm 22 beyond the dead point of the first articulation is higher than the force needed to remain in the engaged position, the actuator 25 is also arranged to apply a force on the articulated arm 22 to move the articulated arm 22 from an engaged position to a disengaged position. In order to ensure a correct order and sense in the disengagement of the first and of the second articulations 26, 29 of the articulated arm 22, the first articulation 26 is provided with a position restoring element 30, for example an extension spring element, which element is tensioned in the engaged position of the articulated arm 22. In this preferred embodiment of the articulated arm 22, the first and/or second articulations 26, 29 are provided with bearings 31, which are preferably made of a plastic material, as plastic is relatively insensitive to corrosion. The hinge axles 32 of the first and/or second articulations 26, 29 in said preferably plastic bearings 31 have a relatively large diameter in view of the low allowable contact stresses plastic bearings can withstand.

FIG. 14 shows a perspective view on a pressure block 28 of a pressure unit 16 in the retractable thruster system of FIG. 1. The pressure block is arranged to be hingedly connected to the second end 27 of the articulated arm 22. The pressure unit 16 comprises an elastic element 33 (not shown) arranged to push the canister 2 onto said at least one trunk contact surface 5. The elastic element 33 is inserted between an upper part 34 of the pressure block 28 and a lower part 35 of the pressure block 28 and is kept in place by protruding bumps 36 in the lower part 35 of the pressure block 28. The upper part 34 and the lower part 35 of the pressure block 28 are substantially made of steel, whereas the elastic element 33 can for example be a rubber block or any other suitable elastic element. The elastic element 33 preferably has a high stiffness in the substantially vertical pushing direction to transfer the pressure force, but a high elasticity in a lateral direction to compensate for slight misalignments of the exerted forces. The elastic element ensures that the compressive force can vary within set limits over a long range of distance of compression. The pressure block 28 can further be provided with an adjustment system 37, for example comprising a bolting system, arranged to adjust the pressure force transmitted via the upper part 34 of the pressure block 28 on the elastic element 33 before a first use of the pressure unit 16 in the retractable thruster system, for example by pre-tensioning said pressure block 28. If pressure decreases due to wear of the elastic element 33 in the pressure block 28, shims can for example be added to the elastic element 33 to restore the initial pressure force.

FIGS. 15, 16 and 17 show a preferred embodiment of a pinion drive 7 of a rack-and-pinion lifting system in the retractable thruster system of FIG. 1. In particular, FIG. 15 shows a perspective front view of the pinion drive 7, FIG. 16 shows a schematic front view of the pinion drive 7, and FIG. 17 shows a schematic side view of the pinion drive 7. The pinion drive 7 comprises an upper part 38 and a lower part 39. The upper part 38 of the pinion drive 7 comprises at least one pinion 8, or for example two pinions 8 (not shown in FIG. 15), which are arranged to engage a rack 6 fixedly connected to a vessel's hull structure. The lower part 39 is arranged to be fixedly connected to the canister 2, for example on a canister's top area 17 (see FIG. 10). The lower part 39 can be fixated to the canister 2 in any known and suitable way, as for example with bolting, riveting, welding, or in any other way. The lower part 39 is movably connected with said upper part 28 such that said lower part 39 is movable in a plane which is transverse to an axial direction of the at least one pinion 8. A slight movement of the canister 2 can thus be compensated for by the two-part pinion drive 7, and does not put extra load on the pinions 8 engaging the rack 6. The pinion drive 7, the lower part 39 of the pinion drive 7 can be connected to the upper part 38 of the pinion drive 7 via a double linkage, for example via a parallelogram linkage including two connection plates 40, each being hingedly connected via two hinge axles 41 with the upper part 38 and with the lower part 39 of the pinion drive 7. The pinion drive 7 may further include a protection plate 42 (see FIG. 17) arranged to limit a movement of the lower part 39 of the pinion drive, in order to avoid contact between said lower part 39 and the upper part 38 of the pinion drive 7. The lower part 39 of the pinion drive 7 can also comprise a locking pin 43 arranged to block the canister 2 in the extended position or in the at least one retracted position. The locking pin 43 may for example be received in a corresponding hole in the rack 6. The rack 6 can for example comprise two holes, one for blocking the canister in the extended position to provide a supplementary hold of the canister the thruster is in operation, and one for blocking the canister 2 in a retracted position to provide a partial relief of the load on the pinions 8. Additional locking pins with a loose fit can also be engaged to ensure water tightness of the trunk 3 if the fixation system fails. These additional locking pins can provide an additional locking redundancy of the canister in the extended position. Due to the loose fit, the additional locking pins do not carry any load when the fixation system functions normally. If however, for any reason, a high external force pushed the canister 2 upwardly into the trunk 3, thus compressing the elastic element 33, for example for more than 10 mm, the additional locking pins would hit the rack and start to carry and transfer load from the canister 2 into the vessel's hull structure. The pinion drive 6 can further comprise at least one guiding plate 44 to guide a vertical movement of the canister 2 in the trunk 3. In the preferred embodiment of the pinion drive in FIGS. 15-17, the upper part 38 of the pinion drive 7 comprises two parallel substantially vertical guiding plates 44 to guide the movement of the upper part 38 of the pinion drive 7 including the pinions 8 in the rack 6, and the lower part 39 of the pinion drive 7 also comprises two parallel substantially vertical guiding plates 44 to guide a movement of the canister 2 in the trunk 3.

It is noted that the figures are only schematic representations of embodiments of the invention that are given by way of non-limiting example.

For the purpose of clarity and a concise description, features are described herein as part of the same or separate embodiments, however, it will be appreciated that the scope of the invention may include embodiments having combinations of all or some of the features described. It may be understood that the embodiments shown have the same or similar components, apart from where they are described as being different.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage.

Many variants will be apparent to the person skilled in the art. All variants are understood to be comprised within the scope of the invention defined in the following claims.

LIST OF REFERENCES

1. Thruster
2. Canister
3. Trunk
4. Canister contact surface
5. Trunk contact surface
6. Rack
7. Pinion drive
8. Pinion
9. Lock access
10. Canister's side wall
11. Canister support structure
12. Trunk's inner wall
13. Parallel sheet plate
14. Edge of parallel sheet plate
15. Transverse sheet plate
16. Pressure unit

17. Canister's top area
18. Canister's bottom area
19. Thruster connection plate
20. Slit
21. Support brackets
22. Articulated arm
23. Engagement element
24. First end of articulated arm
25. Actuator
26. First articulation of the articulated arm
27. Second end of the articulated arm
28. Pressure block
29. Second articulation of the articulated arm
30. Position restoring element
31. Bearing
32. Hinge axle of pressure unit
33. Elastic element
34. Upper part of the pressure block
35. Lower part of the pressure block
36. Bump
37. Adjustment system
38. Upper part of the pinion drive
39. Lower part of the pinion drive
40. Connection plate
41. Hinge axle of pinion drive
42. Protection plate
43. Locking pin
44. Guiding plate
45. Vertical support structure

The invention claimed is:

1. Retractable thruster system for moving a thruster on a vessel between an extended position, in which the thruster is extended below a hull's bottom, and at least one retracted position, in which the thruster is located above the hull's bottom, the system comprising a canister to which a thruster is mountable, wherein the canister is configured to be movable in a trunk in a vessel's hull structure between said extended position and said at least one retracted position, wherein the canister is arranged to provide frictional contact between at least one canister contact surface on said canister and at least one corresponding trunk contact surface on the trunk when the thruster is in said extended position in order to transfer thrust load from the thruster in operation onto the vessel's hull structure, wherein the system further comprises a pressure unit configured to increase pressure of the canister onto the at least one trunk contact surface, and a lifting system configured to move the canister in the trunk between said extended position and said at least one retracted position.

2. Retractable thruster system according to claim 1, wherein said at least one canister contact surface comprises a substantially frustoconical contact surface arranged to provide frictional forces and compressive forces between said at least one canister contact surface and said at least one corresponding trunk contact surface.

3. Retractable thruster system according to claim 1, wherein said at least one canister contact surface comprises a substantially horizontal contact surface arranged to provide substantially horizontal frictional forces between said at least one canister contact surface and said at least one corresponding trunk contact surface.

4. Retractable thruster system according to claim 1, wherein said at least one canister contact surface comprises a substantially vertical contact surface arranged to provide compressive forces between said at least one canister contact surface and said at least one corresponding trunk contact surface.

5. Retractable thruster system according to claim 1, wherein the at least one canister contact surface is arranged in a bottom area of the canister.

6. Retractable thruster system according to claim 1, wherein said pressure unit is arranged to pull the canister onto said at least one trunk contact surface, or wherein said pressure unit is arranged to push the canister onto said at least one trunk contact surface.

7. Retractable thruster system according to claim 6, wherein said pressure unit comprises an articulated arm movable between a disengaged position, and an engaged position in which the canister is pushed onto the at least one trunk contact surface, and/or wherein the arm of said pressure unit is articulated in such a way that the arm of the pressure unit is blocked in an engaged position without application of an external force on said arm.

8. Retractable thruster system for moving a thruster on a vessel between an extended position, in which the thruster is extended below a hull's bottom, and at least one retracted position, in which the thruster is located above the hull's bottom, the system comprising a canister to which a thruster is mountable;

a trunk in a vessel's hull structure in which the canister is movable between said extended position and said at least one retracted position;

wherein the canister is arranged to provide frictional contact between at least one canister contact surface on said canister and at least one trunk contact structure on the trunk when the thruster is in said extended position in order to transfer thrust load from the thruster in operation onto the vessel's hull structure, the system further comprising a pressure unit configured to increase pressure of the canister onto the at least one trunk contact structure, and a lifting system configured to move the canister in the trunk between said extended position and said at least one retracted position.

9. Retractable thruster system according to claim 8, wherein said at least one trunk contact surface comprises a substantially frustoconical contact surface arranged to provide frictional forces and compressive forces between said at least one trunk contact surface and said at least one corresponding canister contact surface.

10. Retractable thruster system according to claim 8, wherein said at least one trunk contact surface comprises a substantially horizontal contact surface arranged to provide substantially horizontal frictional forces between said at least one trunk contact surface and said at least one corresponding canister contact surface.

11. Retractable thruster system according to claim 8, wherein said at least one trunk contact surface comprises a substantially vertical contact surface arranged to provide compressive forces between said trunk contact surface and said at least one corresponding canister contact surface.

12. Retractable thruster system according to claim 8, wherein the at least one trunk contact surface is arranged on at least one canister support structure provided on the trunk, and/or wherein said at least one canister support structure is located in a bottom area of the trunk.

13. Retractable thruster system according to claim 8, wherein said pressure unit comprise an articulated arm movable between a disengaged position, and an engaged position in which the canister is pushed onto the at least one trunk contact surface, and/or wherein an inner wall of said trunk comprises an engagement element arranged to receive a first end of an articulated arm of the pressure unit in an engaged position.

14. Method for fixating a canister in a trunk of a vessel's hull, comprising movably arrange the canister in the trunk, such that the canister is movable between an extended position, in which a thruster, mountable to the canister, is extended below a hull's bottom, and at least one retracted position, in which the thruster is located above a hull's bottom;

providing at least one canister contact surface on the canister providing at least one trunk contact surface on the trunk corresponding to the canister contact surface;

moving the canister with respect to the trunk such that the at least one canister contact surface is in contact with the at least one corresponding trunk contact surface to provide frictional contact between the at least one canister contact surface on said canister and said at least one corresponding trunk contact surface on the trunk when the thruster is in said extended position in order to transfer thrust load from the thruster in operation onto a vessel's hull structure wherein a pressure unit is configured to increase pressure of the canister onto the at least one trunk contact surface, and wherein a lifting system moves the canister in the trunk between said extended position and said at least one retracted position.

15. Method according to claim 14, wherein the pressure unit pushes the canister onto said at least one trunk contact surface, without application of an external force.

16. Method according to claim 15, wherein an actuator moves an articulated arm of the pressure unit from a disengaged position into an engaged position, in which the canister is pushed onto the at least one trunk contact surface, or from said engaged position into said disengaged position.

* * * * *